United States Patent [19]

Nye

[11] 3,999,315

[45] Dec. 28, 1976

[54] ADJUSTABLE ATTACHMENT FOR A BACKHOE

[76] Inventor: John Charles Nye, 3585 Mavis Road, Mississauga, Ontario, Canada

[22] Filed: Oct. 3, 1975

[21] Appl. No.: 619,467

[30] Foreign Application Priority Data

Oct. 10, 1974 Canada ..... 211171

[52] U.S. Cl. ..... 37/141 T; 172/743; 172/713; 172/748; 172/709

[51] Int. Cl.[2] ..... A01B 23/02; E02F 9/28; E02F 3/60

[58] Field of Search ..... 37/80 R, 141 T; 172/748, 733, 743, 710, 713, 709

[56] References Cited

UNITED STATES PATENTS

| | | | |
|---|---|---|---|
| 2,723,472 | 11/1955 | Bartlett | 172/743 X |
| 2,969,966 | 1/1961 | Matheis | 37/80 R |

*Primary Examiner*—George J. Marlo

[57] ABSTRACT

An adjustable attachment for a backhoe comprises a single tooth pivotally connected to a frame, the tooth being capable of taking a plurality of angularly spaced apart positions on the frame. Tensioning means hold the tooth in a desired position, but also allow the position of the tooth to be changed by the backhoe operator by using the backhoe controls without having to leave the controls.

7 Claims, 4 Drawing Figures

ADJUSTABLE ATTACHMENT FOR A BACKHOE

BACKGROUND OF THE INVENTION

1. Field of the Invention

This invention relates to an implement having an adjustable blade unit, and more particularly to an adjustable attachment for a backhoe for earth working.

2. Description of the Prior Art

It is known to provide a backhoe with an attachment consisting of a single relatively narrow tooth that can be forced into frozen earth, and into shale or sandstone that cannot be penetrated by using a multi-toothed bucket or shovel. It is also known to arrange the single tooth of the attachment so that it can occupy three positions, namely, a central position, and a position at either side to which the tooth can be swung from the central position. The tooth is held in any one of its three positions by a locking mechanism which must be released manually in order to move the tooth to another position.

SUMMARY OF THE INVENTION

The present invention provides a device wherein the position of the tooth or other blade unit can be varied by the machine operator without the operator having to leave the controls.

The invention provides an adjustable implement comprising a frame, a tooth at the front of said frame and pivotally connected to said frame, the tooth being engageable with the frame in a plurality of angularly spaced apart positions, means for locking said tooth in any one of said positions, and resilient means by which said tooth is biased towards the rear of said frame such that the angular position of the tooth can be changed by exerting pressure against the tooth to overcome the bias of said resilient means.

BRIEF DESCRIPTION OF THE DRAWINGS

Preferred embodiments of the applicant's invention can best be described in conjunction with the drawings in which.

DESCRIPTION OF THE PREFERRED EMBODIMENTS

Figures 1, 2:
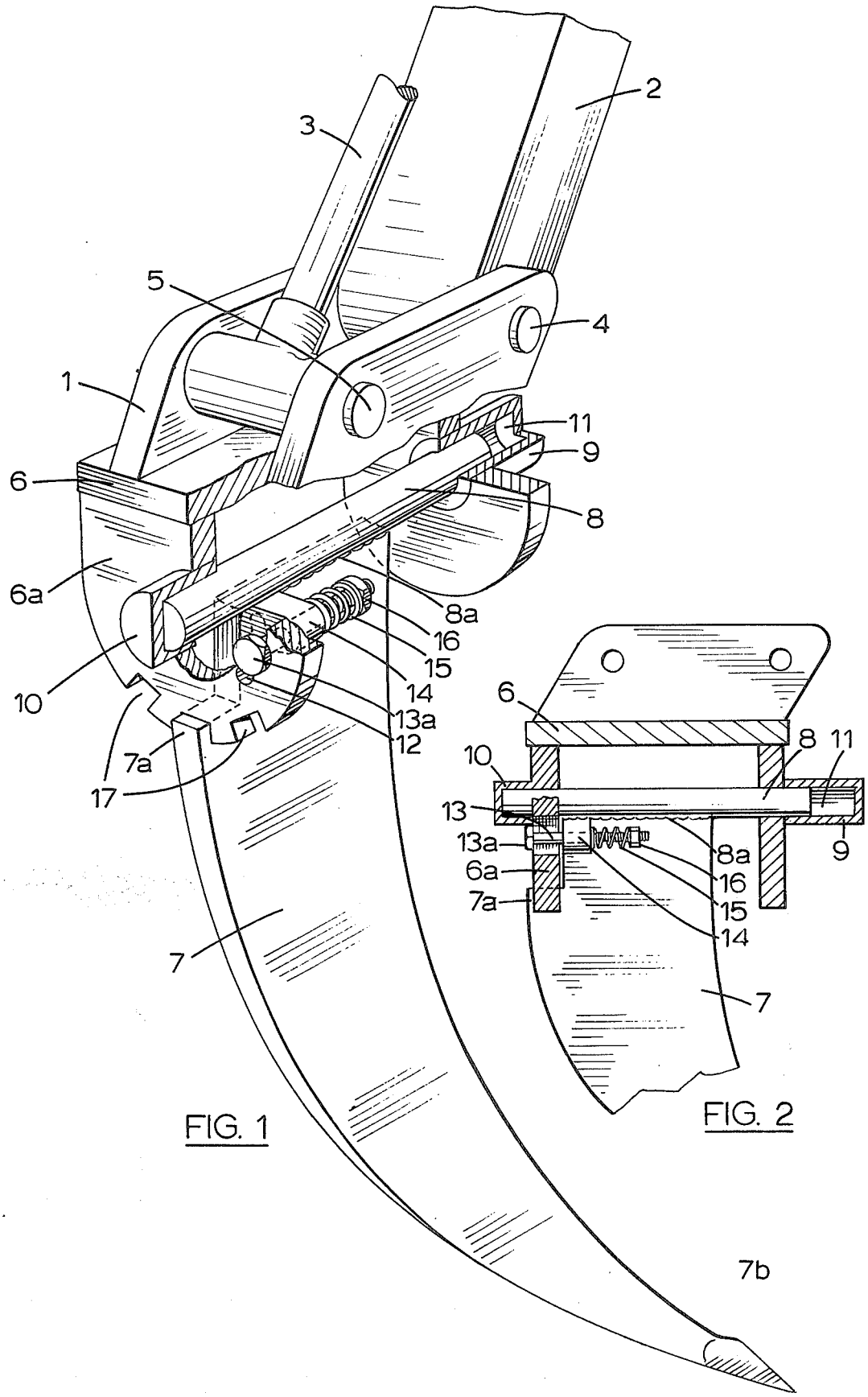
FIG. 1 is a perspective partly cut-away rear view of one embodiment of the invention.
FIG. 2 is a side cut-away view of the same embodiment of the invention.

In FIG. 1, a backhoe attachment 1 according to the invention is secured to a backhoe boom 2 and a tool cylinder push rod 3 by pivot pins 4, 5 respectively. The attachment 1 consists mainly of a frame 6 and a long tapered blade or tooth 7. The tooth 7 is pivotally mounted in the frame 6 through a spindle 8 that is welded at 8*a* to the tooth 7 and is journalled in cylindrical bosses 9, 10 in the frame. When the tooth 7 is in the normal working position as shown in FIG. 1, there is a space 11 between the spindle 8 and the end of the front boss 9. In the rear wall 6*a* of the frame 6 is an arcuate aperture 12 through which passes a bolt 13 having a head 13*a* which cannot pass through the aperture 12. The bolt 13 also passes slidably through a bracket 14 fixed to the tooth 7. A coil spring 15 around the bolt 13 is partially compressed between the bracket 14 and a nut 16 and this spring 15 biases the tooth 7 and the spindle 8 toward the rear wall 6*a* of the frame 6. The rear wall 6*a* of the frame 6 has three angularly spaced apart slots 17. The tooth 7 is indented near the spindle 8 to form a lug 7*a* which can fit into any one of the three slots 17, whereby the tooth is engaged with the frame 6 in a manner that prevents angular movement of the tooth on the spindle 8.

Figure 3:
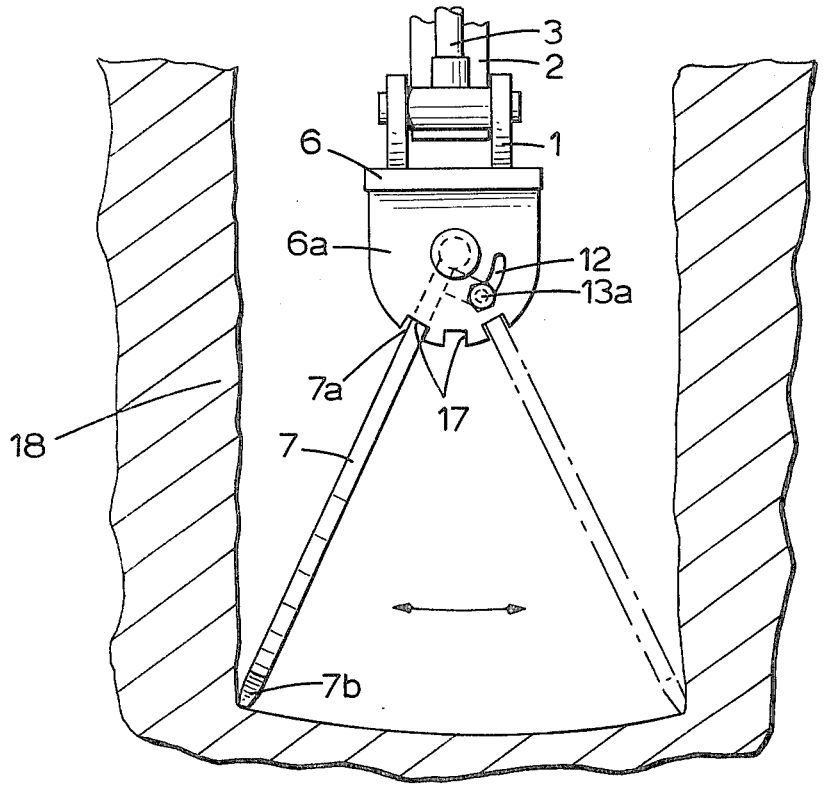
FIG. 3 is a rear view on a smaller scale of the same embodiment of the invention working in a trench.

In FIG. 3, the attachment 1 is shown working in a trench 18. The tooth 7 is shown in the left hand position with the lug 7*a* secured in the left slot 17. The broken lines indicate the position which the tooth 7 would take if it were in the right hand position. The blade or tooth 7 when placed on the ground and pulled in the working direction, that is, in a direction causing the tip 7*b* of the blade or tooth to dig into the earth, can be used to form side walls of trenches as indicated in FIG. 3 or to rip frozen ground or sandstone.

The action of the spring 15 keeps the tooth 7 firmly against the rear wall 6*a* of the frame 6, thus keeping the lug 7*a* firmly in one of the three slots 17. To change the position of the tooth 7, it is necessary to overcome the force of the spring 15 by further compressing it to allow the spindle 8 to move forwardly into the space 11 in the boss 9. When the spindle 8 is shifted into this space, the lug 7*a* will be clear of the rear wall 6*a* of the frame 6. When the lug 7*a* is free of the wall 6*a*, the tooth 7 can be pivoted on the spindle 8 to a new location. The arcuate aperture 12 is of such a length that when the bolt 13 is abutted against either end of the aperture 12, the tooth 7 will then be properly aligned with the corresponding outer slot 17 as illustrated in FIG. 3.

To overcome the force of the spring 15, the operator of the backhoe, using the hydraulic controls (not shown) of the backhoe, bears down with the tooth 7 against the ground or wall of the trench and then shifts the frame rearwardly relative to the tooth 7, compressing the spring 15. When the spring 15 has been compressed sufficiently to free the lug 7*a* from the slot 17, the operator actuates the controls to swing the boom so that the tooth will pivot on the spindle 8 and relocate in front of the slot 17 corresponding to the desired new tooth position. The controls are then operated to free the tooth, so that the lug 7*a* will pop into the new slot 17 due to the force of the spring 15. Thus the position of the tooth can be changed without the operator leaving the controls of the backhoe.

Figure 4:
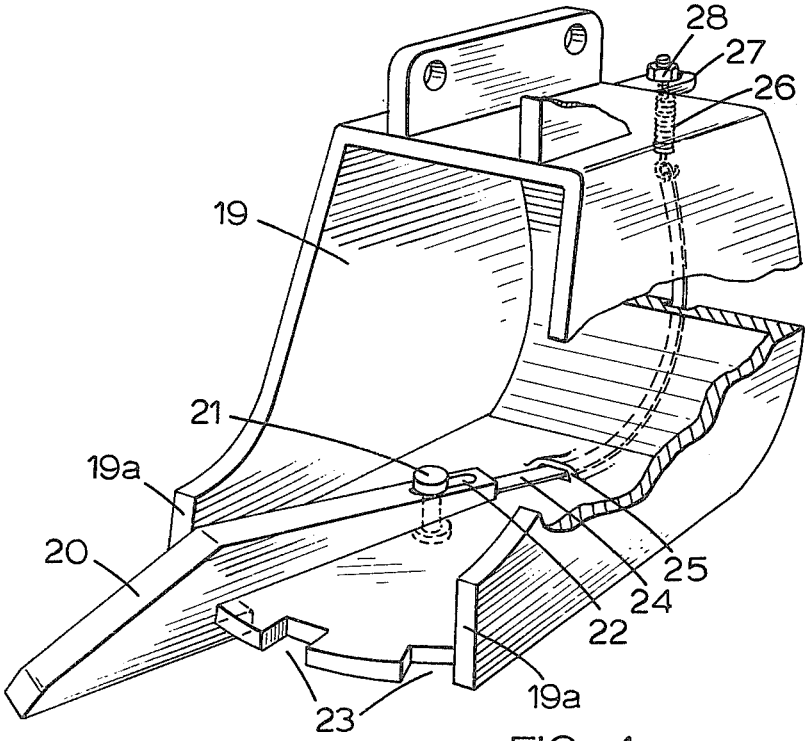
FIG. 4 is a perspective partly cut-away view of another embodiment of the invention.

In FIG. 4, another embodiment of the invention is illustrated. In this embodiment, the frame 19 is in the shape of a bucket. A tapered blade or tooth 20 is pivotally mounted on the frame 19 by pin 21. The tooth 20 can move relative to the pin 21 in a slot 22 in the tooth. The tooth 20 fits tightly into one of the forward slots 23 in the frame 19 and is normally held in one of these slots by a flexible metal strap 24 which runs in a trough 25 in the frame 19 to a spring 26. The spring 26 is secured to a bracket 27 on the frame 19 by a nut 28, and is in tension.

The tooth 20 can be moved to any one of the three slots 23 in a manner similar to that described above. The operator of the backhoe, using the hydraulic controls, brings the tooth 20 to bear against the ground and swings the bucket frame 19 so as to free the tooth from the front edge of the frame. The operator then swings the bucket to one side so that the tooth can pop into the desired new slot 23. The tension in the spring 26 provides the force for popping the tooth into place. The side walls 19*a* of the frame 19 are alongside the outermost slots 23 and thus act as tooth abutments and guides to aid the operator in aligning the tooth with either of the outer slots 23.

Modifications to the preferred embodiments illustrated herein will occur to those skilled in the art and are intended to be covered by the following claims.

What I claim is:

1. An adjustable implement comprising a blade unit, a frame for supporting and moving the blade unit in a working and a reverse direction, means connecting the blade unit to the frame, the blade unit being movable on the connecting means relative to the frame, the frame having a plurality of blade receiving locations where the blade unit is engageable with the frame, the blade unit in each of said locations being held in engagement with the frame on application of pressure to the blade unit in said reverse direction and being movable out of engagement with the frame on application of pressure to the blade unit in said working direction, and resilient means urging the blade unit in each of said locations into engagement with the frame, the resilient means being deformable on application of pressure to the blade unit in said working direction to allow the blade unit to move on said connecting means out of each of said locations to another location.

2. An adjustable implement as claimed in claim 1 wherein said blade unit is a tooth;

wherein said connecting means comprise a pivotal connection of the tooth to said frame; and wherein said blade receiving locations are angularly spaced apart on the frame.

3. An adjustable implement as claimed in claim 2, wherein the tooth hs a lug engageable in a slot of the frame at each of said angularly spaced apart locations, the lug when in a slot preventing angular movement of the tooth relative to the frame.

4. An adjustable implement as claimed in claim 2, wherein the resilient means comprise a spring secured between the frame and the tooth.

5. An adjustable implement as claimed in claim 1, wherein said frame is a bucket having spaced side walls defining a dirt receiving opening, a front edge at one end of said opening between said sides, and a cross member connecting said sides at the opposite end of said opening;

wherein said blade unit is a tooth protruding from the front edge of said bucket; and, wherein said blade receiving locations comprise a plurality of angularly spaced slots along said front edge of said bucket.

6. An adjustable implement as claimed in claim 5, wherein said connecting means comprise a pin-in-slot connection of the tooth to the bucket; and the resilient means comprise a spring secured to the frame and to a metal strap which extends through a groove in the frame to the tooth.

7. An adjustable attachment as claimed in claim 1, wherein the frame includes an abutment against which the blade can be moved to locate it in one of said blade receiving locations.

* * * * *